US010544382B2

(12) United States Patent
Smith et al.

(10) Patent No.: US 10,544,382 B2
(45) **Date of Patent: *Jan. 28, 2020**

(54) POWDERED AUTOMATIC DISHWASHING DETERGENT

(71) Applicant: Melaleuca, Inc., Idaho Falls, ID (US)

(72) Inventors: Daniel Smith, Rigby, ID (US); Merrill Judy, Ammon, ID (US)

(73) Assignee: Melaleuca, Inc., Idaho Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/515,895

(22) Filed: Oct. 16, 2014

(65) Prior Publication Data

US 2015/0105309 A1 Apr. 16, 2015

Related U.S. Application Data

(60) Provisional application No. 61/891,766, filed on Oct. 16, 2013.

(51) Int. Cl.

| | |
|---|---|
| ***C11D 17/06*** | (2006.01) |
| ***C11D 17/04*** | (2006.01) |
| ***C11D 1/72*** | (2006.01) |
| ***C11D 1/722*** | (2006.01) |
| ***C11D 3/00*** | (2006.01) |
| ***C11D 3/20*** | (2006.01) |
| ***C11D 3/38*** | (2006.01) |
| ***C11D 1/66*** | (2006.01) |
| ***C11D 3/386*** | (2006.01) |
| ***C11D 3/37*** | (2006.01) |
| ***C11D 3/04*** | (2006.01) |
| ***C11D 3/30*** | (2006.01) |
| ***C11D 3/382*** | (2006.01) |

(52) U.S. Cl.

CPC ..... *C11D 1/66* (2013.01); *C11D 1/72* (2013.01); *C11D 3/046* (2013.01); *C11D 3/2086* (2013.01); *C11D 3/30* (2013.01); *C11D 3/3769* (2013.01); *C11D 3/382* (2013.01); *C11D 3/38609* (2013.01); *C11D 17/044* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 3,860,525 | A * | 1/1975 | Bechtold | C11D 3/04 510/101 |
| 5,529,715 | A * | 6/1996 | Kuroda | C11D 3/10 510/323 |
| 5,698,504 | A * | 12/1997 | Christie | C11D 3/0073 252/387 |
| 5,872,111 | A * | 2/1999 | Au | A61K 31/70 514/42 |
| 5,981,456 | A * | 11/1999 | Tartakovsky | C11D 3/0073 510/220 |
| 6,334,452 | B1 * | 1/2002 | Tartakovsky | C11D 1/62 134/25.2 |
| 6,759,228 | B2 * | 7/2004 | Takaiwa | C11D 3/386 435/183 |
| 7,429,642 | B2 * | 9/2008 | Okuda | C12N 9/54 435/221 |
| 2003/0073596 | A1 * | 4/2003 | Chiou | C11D 3/227 510/221 |
| 2006/0042662 | A1 * | 3/2006 | Geret | C11D 3/3472 134/25.1 |
| 2006/0118141 | A1 * | 6/2006 | Andriola | C11D 3/0052 134/42 |
| 2007/0135323 | A1 * | 6/2007 | Wiedemann | C11D 3/168 510/220 |
| 2008/0261849 | A1 * | 10/2008 | Preuschen | C11D 3/2082 510/228 |
| 2011/0266169 | A1 * | 11/2011 | Catlin | B65B 9/04 206/216 |
| 2012/0171754 | A1 * | 7/2012 | Bessler | C11D 3/166 435/263 |
| 2016/0230121 | A1 | 8/2016 | Smith | |

FOREIGN PATENT DOCUMENTS

| | | |
|---|---|---|
| CA | 2762583 A1 | 6/2013 |

OTHER PUBLICATIONS

International Search Report and Written Opinion for PCT/US2014/60875, dated Jan. 14, 2015, 12 pages.

* cited by examiner

*Primary Examiner* — Lorna M Douyon

(74) *Attorney, Agent, or Firm* — Fish & Richardson P.C.

(57) ABSTRACT

This disclosure relates to powdered automatic dishwashing detergents. More particularly, this disclosure relates to powdered automatic dishwashing detergent packets with superior environmental and human safety as well as superior cleaning efficacy and stability.

29 Claims, No Drawings

POWDERED AUTOMATIC DISHWASHING DETERGENT

CROSS-REFERENCE TO RELATED APPLICATIONS

This application claims priority to U.S. Provisional Application Ser. No. 61/891,766, filed Oct. 16, 2013, and which is herein incorporated by reference in its entirety.

BACKGROUND

1. Technical Field

This disclosure relates to powdered automatic dishwashing detergents. More particularly, this disclosure relates to powdered automatic dishwashing detergent packets with superior environmental and human safety as well as superior cleaning efficacy and stability.

2. Background

Many automatic dishwashing detergents currently available are suitable for their intended purposes, i.e., effectively cleaning and leaving previously soiled eating and cooking utensils in a generally spot-free, clean condition. Known automatic dishwashing detergents, however, often contain some combination of one or more of three ingredients, including bleach, caustic soda, and phosphates. These substances can be deleterious, for various reasons. For example, phosphates are minerals that act as water softeners and are considered by some to be among the worst pollutants found in detergents. Phosphates are a nutrient, and can act as a fertilizer for algae. Thus, when phosphates enter waterways, they promote the growth of algae and other plants. In the presence of large amounts of phosphates and other similar nutrients, excessive algae growth occurs. This causes odors and creates hypoxic conditions. Some states have banned the use of phosphates in all detergents, other than automatic dishwasher detergents.

SUMMARY

Provided herein are powdered detergent compositions for use in automatic dishwashing machines. For example, the powder compositions provided herein can contain one or more of a low foaming nonionic surfactant, a non-phosphate detergent builder, a detergent enzyme, and a sheeting polymer. In some cases, compositions provided herein can contain less than about 1% by weight of water or other solvent and lack phosphate builders and bleach or other bleaching agents. In addition, compositions provided herein can be contained within a water-soluble film container to prepare a monophasic automatic dishwashing detergent packet.

Provided herein is a powder detergent composition including:

(a) about 0.5 to about 15% by weight of a surfactant, wherein said surfactant is a low foaming nonionic surfactant;

(b) about 30 to about 90% by weight of a non-phosphate detergent builder, wherein said non-phosphate detergent builder is selected from the group consisting of citric acid or a soluble salt form of citric acid;

(c) about 0.02 to about 5% by weight of a detergent enzyme; and (d) about 0.05 to about 3% by weight of a sheeting polymer; wherein the composition includes less than about 1% by weight of water or other solvent.

In some embodiments, the low foaming nonionic surfactant is selected from the group consisting of:

(a) first condensation products, wherein said first condensation products are condensates from a first mixture containing about one mole of a straight or branched chain fatty alcohol or fatty acid and from about four to about forty moles of ethylene oxide, wherein said alcohol or acid is saturated or unsaturated, and wherein the chain of said alcohol or acid contains from about ten to about twenty carbon atoms;

(b) second condensation products, wherein said second condensation products are condensates from a second mixture containing about one mole of alkyl phenol and from about four to about fifty moles of ethylene oxide, wherein the alkyl chain of said alkyl phenol contains from about eight to about eighteen carbon atoms;

(c) polyoxypropylene, polyoxyethylene condensates having the formula $R_1O(CH_2CH_2O)_x(CH(CH_3)CH_2O)_yR_2$, wherein $R_1$ is H or an alkyl group having from one to four carbon atoms, wherein $R_2$ is H or an alkyl group having from one to four carbon atoms, wherein x is an integer greater than or equal to one, wherein y is an integer greater than or equal to one, wherein the total $C_2H_4O$ content is from about 20 percent to about 90 percent of the total weight of said polyoxypropylene, polyoxyethylene condensates, and wherein the molecular weight of said polyoxypropylene, polyoxyethylene condensates is from about 2000 Daltons to about 10,000 Daltons; and (d) capped condensates, wherein said capped condensates comprise said polyoxypropylene, polyoxyethylene condensates capped with at least one capping molecule, said capping molecule being selected from the group consisting of propylene oxide, butylene oxide, short chain alcohols, and short chain fatty acids.

In some embodiments, the surfactant is a polyoxypropylene polyoxyethylene condensate.

In some embodiments, the non-phosphate detergent builder is a soluble salt of citric acid. For example, the non-phosphate detergent builder can be an alkali metal salt of citric acid, an ammonium salt of citric acid, or a mixture thereof. In some embodiments, the non-phosphate detergent builder is a sodium salt of citric acid. For example, the non-phosphate detergent builder is sodium citrate dihydrate.

In some embodiments, the detergent enzyme is selected from lipases, mannanases, cellulases, zylenases, proteases, amylases, and mixtures of two or more thereof. For example, the detergent enzyme is selected from a protease, an amylase, or mixtures thereof.

In some embodiments, the sheeting polymer is diallyldimethylammonium chloride.

In some embodiments, the compositions provided herein can be free of phosphate builders and/or bleach and other bleaching agents.

In some embodiments, the composition further comprises from about 0.001 to about 5% by weight of one or more essential oils. For example, the one or more essential oils can be selected from the group consisting of: abies, bitter, seed, angelica, anise, balsam, basil, bay, benzoin, bergamot, birch, rose, cajuput, calamus, cananga, capsicum, caraway, cardamon, cassia, Japanese cinnamon, acacia, cedarwood, celery, camomile, hay podge, cinnamon, citronella, clove, coriander, costus, cumin, dill, elemi, estragon, eucalyptus, fennel, galbanum, garlic, geranium, ginger, ginger grass, grapefruit, guaiac wood, white cedar, hinoki, hop, hyacinth, Jasmine, jonquil, juniper berry, laurel, lavandin, lavender, lemon, lemongrass, lime, linaloe, richea cubeb, lovage, mandarin, Melaleuca alternifolia leaf oil, mint, minosa, mustard, myrrh, myrtle, narcissus, neroli, nutmeg, oak moss, ocotea, olibanum, onion, opopanax, orange, oris, parsley, patchouli, palmarosa, pennyroyal, pepper, perilla, petitgrain, pimento, pine, rose, rosemary, camphor, clary sage, sage, sandalwood, spearmint, spike, star anise, styrax, thyme, tonka, tuberose, terpin, vanilla, vetiver, violet, wintergreen, worm wood, and ylang ylang. In some embodiments, the essential oils are selected from the group consisting of: Melaleuca alternifolia leaf oil and orange oil.

In some embodiments, the composition further includes from about 0.05 to about 5% by weight of a preservative. For example, a preservative can be selected from the group consisting of propylene glycol, sorbitol, fructose, sucrose, glucose, short chain carboxylic acids, salt forms of short chain carboxylic acids, polyhydroxyl compounds, boric acid, soluble salt forms of boric acid, boronic acid, soluble salt forms of boronic acid, sorbic acid, soluble salt forms of sorbic acid, calcium ions, and mixtures thereof. In some embodiments, the preservative is selected from sorbic acid, soluble salt forms of sorbic acid, calcium ions, and mixtures thereof.

In some embodiments, the composition further includes from about 0.5 to about 5% by weight of a flow aid. For example, the flow aid can be selected from the group consisting of: silica and aluminosilicate.

In some embodiments, the composition further includes from about 0.05 to about 2% by weight of fragrance.

In some embodiments, the composition includes:

(a) about 0.5 to about 15% by weight of a surfactant, wherein said surfactant is a low foaming nonionic surfactant;

(b) about 30 to about 90% by weight of a non-phosphate detergent builder, wherein said non-phosphate detergent builder is selected from the group consisting of citric acid or a salt form thereof;

(c) about 0.02 to about 5% by weight of a detergent enzyme;

(d) about 0.05 to about 3% by weight of a sheeting polymer;

(e) about 0 to about 5% by weight of a preservative;

(f) about 0.5 to about 5% by weight of a flow aid;

(g) from 0 to about 5% by weight of one or more essential oils; and (h) from 0 to about 2% by weight of fragrance;

wherein the composition includes less than about 1% by weight of water or other solvent.

In some embodiments, the composition includes:

(a) about 1 to about 10% by weight of a surfactant, wherein said surfactant is a low foaming nonionic surfactant;

(b) about 80 to about 90% by weight of a non-phosphate detergent builder, wherein said non-phosphate detergent builder is selected from the group consisting of citric acid or a salt form thereof;

(c) about 0.5 to about 2% by weight of a detergent enzyme; and (d) about 0.1 to about 1% by weight of a sheeting polymer;

wherein the composition includes less than about 1% by weight of water or other solvent.

For example, the composition can include:

(a) about 1 to about 10% by weight of a surfactant, wherein said surfactant is a low foaming nonionic surfactant;

(b) about 80 to about 90% by weight of a non-phosphate detergent builder, wherein said non-phosphate detergent builder is selected from the group consisting of citric acid or a salt form thereof;

(c) about 0.5 to about 2% by weight of a detergent enzyme;

(d) about 0.1 to about 1% by weight of a sheeting polymer;

(e) about 0 to about 5% by weight of a preservative;

(f) about 0.5 to about 5% by weight of a flow aid;

(g) from 0 to about 1% by weight of one or more essential oils; and (h) from 0 to about 2% by weight of fragrance;

wherein the composition includes less than about 1% by weight of water or other solvent.

In some embodiments, the composition includes:

(a) about 1 to about 10% by weight of a polyoxypropylene polyoxyethylene condensate;

(b) about 80 to about 90% by weight of sodium citrate dihydrate;

(c) about 0.5 to about 2% by weight of a mixture of amylase and protease enzymes; and (d) about 0.1 to about 1% by weight of diallyldimethylammonium chloride; wherein the composition includes less than about 1% by weight of water or other solvent.

For example, the composition can include:

(a) about 1 to about 10% by weight of a polyoxypropylene polyoxyethylene condensate;

(b) about 80 to about 90% by weight of sodium citrate dihydrate;

(c) about 0.5 to about 2% by weight of a mixture of amylase and protease enzymes;

(d) about 0.1 to about 1% by weight of diallyldimethylammonium chloride;

(e) about 0 to about 5% by weight of a mixture of sorbic acid, citric acid, and calcium chloride;

(f) about 0.5 to about 5% by weight of silica;

(g) from 0 to about 1% by weight of Melaleuca alternifolia leaf oil; and (h) from 0 to about 2% by weight of fragrance;

wherein said composition comprises less than about 1% by weight of water or other solvent.

In some embodiments, the composition includes:

(a) about 6% by weight of a polyoxypropylene polyoxyethylene condensate;

(b) about 87% by weight of sodium citrate dihydrate;

(c) about 1% by weight of a mixture of amylase and protease enzymes; and (d) about 0.5% by weight of diallyldimethylammonium chloride;

wherein the composition includes less than about 1% by weight of water or other solvent.

For example, the composition can include:

(a) about 6% by weight of a polyoxypropylene polyoxyethylene condensate;

(b) about 87% by weight of sodium citrate dihydrate;

(c) about 1% by weight of a mixture of amylase and protease enzymes;

(d) about 0.5% by weight of diallyldimethylammonium chloride;

(e) about 3.4% by weight of a mixture of sorbic acid, citric acid, and calcium chloride;

(f) about 2% by weight of silica;

(g) about 0.003% by weight of Melaleuca alternifolia leaf oil; and (h) about 0.2% by weight of fragrance;

wherein the composition comprises less than about 1% by weight of water or other solvent.

Also provided herein is an automatic dishwashing detergent packet including:

(a) a water soluble container comprising a water-soluble film; and (b) a powder detergent composition of the present disclosure within said container.

In some embodiments, the container includes a single-layer of said water-soluble film wherein the water-soluble film has an internal surface directly contacting the powder detergent composition and an external surface which is an outermost portion of the packet. In some embodiments, the water-soluble film comprises polyvinyl alcohol. In some embodiments, the container consists essentially of said water-soluble film and said water-soluble film consists essentially of polyvinyl alcohol. In some embodiments, the automatic dishwashing detergent packet is a monophasic automatic dishwashing detergent packet.

Unless otherwise defined, all technical and scientific terms used herein have the same meaning as commonly understood by one of ordinary skill in the art to which this invention belongs. Methods and materials are described herein for use in the present invention; other, suitable methods and materials known in the art can also be used. The materials, methods, and examples are illustrative only and not intended to be limiting. All publications, patent applications, patents, sequences, database entries, and other references mentioned herein are incorporated by reference in their entirety. In case of conflict, the present specification, including definitions, will control.

Other features and advantages of the invention will be apparent from the following detailed description and from the claims.

DETAILED DESCRIPTION

Provided herein are powdered detergent compositions for use in automatic dishwashing machines. For example, the powder compositions provided herein can contain one or more of a low foaming nonionic surfactant, a non-phosphate detergent builder, a detergent enzyme, and a sheeting polymer. In some cases, compositions provided herein can contain less than about 1% by weight of water or other solvent and lack phosphate builders and bleach or other bleaching agents. In addition, compositions provided herein can be contained within a water-soluble film container to prepare a monophasic automatic dishwashing detergent packet.

Surfactant

A powder detergent composition provided herein can include a surfactant, specifically, a low foaming nonionic surfactant. Surfactants lower the surface tension between food residue and the dishes they are on and act as a detergent to assist in cleaning. A low-foaming nonionic surfactant is a surfactant that foams little, if at all, during the wash cycle of an automatic dishwashing appliance. In addition, a low-foaming nonionic surfactant can function to suppress foaming during the wash cycle caused by food residues.

Examples of nonionic surfactants include, without limitation, various condensation products. For example, the condensation product from a mixture of about one mole of a fatty alcohol or fatty acid and about four to about forty moles of ethylene oxide can be used. The fatty alcohol or fatty acid can be saturated or unsaturated while the chain can be straight or branched. In addition, the chain can contain from ten to twenty carbon atoms. Another nonionic surfactant can be the condensation product from a mixture of about one mole of alkyl phenol and about four to about fifty moles of ethylene oxide. The alkyl chain of the alkyl phenol can contain from eight to eighteen carbon atoms.

Further, polyoxypropylene, polyoxyethylene condensates can be used as nonionic surfactants. Polyoxypropylene, polyoxyethylene condensates can have a chemical formula of $R_1O(CH_2CH_2O)_x(CH(CH_3)CH_2O)_yR_2$ where $R_1$ can be H or an alkyl group having from one to four carbon atoms, where $R_2$ can be H or an alkyl group having from one to four carbon atoms, where x is an integer greater than or equal to one, where y is an integer greater than or equal to one, and where the total $C_2H_4O$ content equals about 20 percent to about 90 percent (e.g., about 20, 25, 30, 35, 40, 45, 50, 55, 60, 65, 70, 75, 80, 85, or 90 percent) of the total weight of the condensation product. In addition, the molecular weight of the polyoxypropylene, polyoxyethylene condensates can be from about 2,000 Daltons to about 10,000 Daltons. Polyoxypropylene, polyoxyethylene condensates can be capped or uncapped. For example, polyoxypropylene, polyoxyethylene condensates can be capped with propylene oxide, butylene oxide, short chain alcohols, short chain fatty acids, or combinations thereof. In some cases, a polyoxypropylene, polyoxyethylene condensate can be MEROXAPOL® 252 (CAS No. 9003-11-6) or PLURONIC® 25R2.

Other nonionic surfactants include, without limitation, those described in McCutcheon's Emulsifiers and Detergents, 1999 North American Edition.

In some cases, a composition provided herein can contain between about 0.5% to about 15% by weight of a polyoxypropylene, polyoxyethylene condensate. For example, about 0.5% to about 14% by weight, about 0.5% to about 12% by weight, about 0.5% to about 10% by weight, about 0.5% to about 8% by weight, about 0.5% to about 7% by weight, about 0.5% to about 6% by weight, about 0.5% to about 4%, about 0.5% to about 2% by weight, about 1% to about 15% by weight, about 3% to about 15% by weight, about 4% to about 15% by weight, about 5% to about 15% by weight, about 8% to about 15% by weight, about 10% to about 15% by weight, about 1% to about 10% by weight, about 2% to about 8% by weight, about 3% to about 7% by weight, and about 4% to about 6% by weight of a polyoxypropylene, polyoxyethylene condensate. In some cases, a composition provided herein can contain about 6% by weight of a polyoxypropylene, polyoxyethylene condensate. For example, a composition can include about 5.941% by weight of a polyoxypropylene, polyoxyethylene condensate such as MEROXAPOL® 252 (CAS No. 9003-11-6) or PLURONIC® 25R2.

In some cases, a composition provided herein can contain between about 0.5% to about 15% by weight of a surfactant. For example, about 0.5% to about 14% by weight, about 0.5% to about 12% by weight, about 0.5% to about 10% by weight, about 0.5% to about 8% by weight, about 0.5% to about 7% by weight, about 0.5% to about 6% by weight, about 0.5% to about 4%, about 0.5% to about 2% by weight, about 1% to about 15% by weight, about 3% to about 15% by weight, about 4% to about 15% by weight, about 5% to about 15% by weight, about 8% to about 15% by weight, about 10% to about 15% by weight, about 1% to about 10% by weight, about 2% to about 8% by weight, about 3% to about 7% by weight, and about 4% to about 6% by weight of a surfactant. In some cases, a composition provided herein can contain about 6% by weight of a surfactant. For example, a composition can include about 5.941% by weight of a low foaming non-ionic surfactant.

In some cases, compositions provided herein do not contain other types of surfactants. For example, compositions provided herein can lack anionic or amphoteric surfactants.

Non Phosphate Detergent Builder

A powder detergent composition provided herein can include a non-phosphate detergent builder. Detergent builders are compounds that remove calcium ions by complexation or precipitation. Examples of non-phosphate builders include, without limitation, citric acid, soluble salt forms of citric acid, nitrilotriacetic acid, soluble salt forms of nitrilotriacetic acid, sodium carboxymethyl oxymalonate, sodium carboxymethyl oxysuccinate, polymers of acrylic acid, copolymers of acrylic acid, polymers of maleic acid, copolymers of maleic acid, soluble salt forms of carbonate, soluble salt forms of bicarbonate, and soluble salt forms of percarbonate. In some embodiments, a non-phosphate detergent builder can be selected from citric acid, a soluble salt form of citric acid, a soluble salt form of carbonate, a soluble salt form of bicarbonate, and a soluble salt form of percarbonate. For example, the salt form can be a sodium salt such as sodium citrate, sodium carbonate, sodium bicarbonate, and sodium percarbonate. In some embodiments, a non-phosphate detergent builder can include citric acid or a soluble salt form of citric acid. For example, the non-phosphate detergent builder can be a soluble salt of citric acid such as an alkali metal salt of citric acid, an ammonium salt of citric acid, or a mixture thereof. In some cases, the non-phosphate detergent builder can be a sodium salt of citric acid such as sodium citrate dihydrate.

In some cases, compositions provided herein can contain about 30% to about 90% by weight of a non-phosphate detergent builder. For example, about 30% to about 80% by weight, about 30% to about 60% by weight, about 30% to about 50% by weight, about 40% to about 90% by weight, about 50% to about 90% by weight, about 60% to about 90% by weight, about 70% to about 90% by weight, about 80% to about 90% by weight, about 40% to about 80% by weight, and about 50% to about 70% by weight of a non-phosphate detergent builder. In some cases, a composition provided herein contains about 70% to about 90% by weight or about 80% to about 90% by weight of a non-phosphate detergent builder. In some embodiments, a composition provided herein can contain about 80% to about 90% by weight of a non-phosphate detergent builder. For example, a composition can contain about 87% by weight of a non-phosphate detergent builder.

In some cases, compositions provided herein can contain about 30% to about 90% by weight of a sodium salt of citric acid. For example, about 30% to about 80% by weight, about 30% to about 60% by weight, about 30% to about 50% by weight, about 40% to about 90% by weight, about 50% to about 90% by weight, about 60% to about 90% by weight, about 70% to about 90% by weight, about 80% to about 90% by weight, about 40% to about 80% by weight, and about 50% to about 70% by weight of a sodium salt of citric acid. In some cases, a composition provided herein contains about 70% to about 90% by weight or about 80% to about 90% by weight of a sodium salt of citric acid. In some embodiments, a composition provided herein can contain about 80% to about 90% by weight of a sodium salt of citric acid. For example, a composition can contain about 87% by weight of a sodium salt of citric acid such as sodium citrate dihydrate.

Detergent Enzyme

The term "detergent enzyme" as used herein refers to any enzyme preparation having the ability to aid in the cleaning process including, without limitation, the removal of debris (e.g., proteinaceous organic food soils and starch-containing food residues), the degradation of debris, and the removal and prevention of spots and film after the wash cycle. Detergent enzymes can be selected from lipases, mannanases, cellulases, zylenases, proteases, amylases, and mixtures of two or more detergent enzymes. In some embodiments, the detergent enzymes can be proteases, amylases, or a mixture thereof. Examples of protease enzyme detergents include, without limitation, Savinase™, Alcalase™, Esperase™, Maxatase™, Maxacal™ and Maxapem™. Examples of amylase enzyme detergents include, without limitation, Maxamyl™ (a bacterial amylase), Termamyl™ (a bacterial amylase), and BAN™ (a bacterial amylase). In some cases, compositions provided herein can include a mixture of protease and amylase detergent enzymes.

In some cases, compositions provided herein can contain about 0.02% to about 10% by weight of a detergent enzyme. For example, about 0.2% to about 8% by weight, about 0.2% to about 6% by weight, about 0.02% to about 5% by weight, about 0.02% to about 4% by weight, about 0.02% to about 3% by weight, about 0.02% to about 2% by weight, about 0.1% to about 10% by weight, about 0.5% to about 10% by weight, about 1% to about 10% by weight, about 3% to about 10% by weight, about 5% to about 10% by weight, about 7% to about 10% by weight, about 0.1% to about 5% by weight, about 0.5% to about 5% by weight, about 1% to about 5% by weight, about 3% to about 5% by weight, about 0.1% to about 3% by weight, about 2% to about 8% by weight, about 3% to about 7% by weight, about 4% to about 8% by weight, about 3% to about 6% by weight, about 0.5% to about 2% by weight, and about 0.75% to about 1.5% by weight of a detergent enzyme. In some cases, compositions provided herein can contain about 0.5% to about 2% by weight or about 0.75% to about 1.5% by weight of a detergent enzyme. For example, compositions provided herein can contain about 0.5% to about 2% by weight or about 0.75% to about 1.5% by weight of a mixture of detergent enzymes such as a mixture of two or more enzymes selected from the group including lipases, mannanases, cellulases, zylenases, proteases, and amylases. In some embodiments, compositions provided herein can contain about 0.5% to about 2% by weight or about 0.75% to about 1.5% by weight of a mixture of amylase and protease enzymes. Mixtures of the enzymes can contain the same or different amounts of each type of enzyme. In some cases, compositions provided herein can contain about 0.5% of an amylase enzyme and 0.5% of a protease enzyme.

Sheeting Polymer

A sheeting polymer can be included in the compositions provided herein to provide a layer on the surfaces of the dishes and afford a sheeting action in the aqueous rinse step. In some cases, the inclusion of a sheeting polymer can obviate the need to include a rinse aid and/or a descaling agent in the composition.

Without wishing to be bound by theory, it is believed that the sheeting polymer adsorbs on the surfaces of the dishes, during the cleaning process. The layer of adsorbed sheeting polymer generally makes these surfaces more hydrophilic. The sheeting polymer thus should be capable to adsorb on the surfaces of the dishes to provide a layer thereon so as to afford a sheeting action in the aqueous rinse step. Water droplets getting into contact with these hydrophilically modified surfaces during rinsing will wet better implying that a continuous thin water film is formed instead of separate droplets. This thin water film will generally dry more uniformly without leaving water marks behind. Therefore, a good visual appearance is obtained without the need to use a rinse aid and/or a descaling agent in the composition.

In some cases, the sheeting polymer is a powder. A non-limiting example of sheeting polymer includes diallyldimethylammonium chloride.

In some cases, compositions provided herein can contain about 0.05% to about 3% by weight of a sheeting polymer. For example, about 0.05% to about 2% by weight, about 0.05% to about 1% by weight, about 0.05% to about 0.75% by weight, about 0.05% to about 0.5% by weight, about 0.05% to about 0.1% by weight, about 0.1% to about 3% by weight, about 0.25% to about 3% by weight, about 0.5% to about 3% by weight, about 1% to about 3% by weight, about 0.1% to about 1% by weight, and about 0.25% to about 0.75% by weight of a sheeting polymer. In some cases, composition provided herein can contain about 0.1% to about 1% by weight, and about 0.25% to about 0.75% by weight of a sheeting polymer. For example, compositions provided herein can contain about 0.5% by weight of a sheeting polymer.

In some cases, compositions provided herein can contain about 0.05% to about 3% by weight of diallyldimethylammonium chloride. For example, about 0.05% to about 2% by weight, about 0.05% to about 1% by weight, about 0.05% to about 0.75% by weight, about 0.05% to about 0.5% by weight, about 0.05% to about 0.1% by weight, about 0.1% to about 3% by weight, about 0.25% to about 3% by weight, about 0.5% to about 3% by weight, about 1% to about 3% by weight, about 0.1% to about 1% by weight, and about 0.25% to about 0.75% by weight of diallyldimethylammonium chloride. In some cases, composition provided herein can contain about 0.1% to about 1% by weight, and about 0.25% to about 0.75% by weight of diallyldimethylammonium chloride. For example, compositions provided herein can contain about 0.5% by weight of diallyldimethylammonium chloride.

Preservative

A powder detergent composition provided herein can include a preservative. The term "preservative" as used herein refers to any compound that acts as one or more of the following: as an enzyme stabilizer, a pH adjuster, an antimicrobial, an antifungal, or a chelator in a composition provided herein. An "enzyme stabilizer" as used herein refers to a compound that enhances or maintains the stability of a detergent enzyme within a composition provided herein. Examples of preservatives include, without limitation, calcium ions, propylene glycol, sorbitol, boric acid, soluble salts of boric acid, boronic acids, soluble salts of boronic acids, citric acid, soluble salts of citric acid, polyhydroxy compounds, carboxylic acids having from one to six carbon atoms (short chain carboxylic acids), and salt forms of carboxylic acids having from one to six carbon atoms (salt forms of short chain carboxylic acids), sorbic acid, soluble salt forms of sorbic acid, and mixtures thereof. In some cases, the preservative is selected from sorbic acid, soluble salt forms of sorbic acid, calcium ions, and mixtures thereof.

Any source can be used to provide calcium ions. For example, soluble salts of calcium such as calcium chloride, bromide, iodide, and nitrate can be used. Typically, the source of calcium ions has a moderate degree of solubility such that the calcium ions become available. Calcium ions can also be provided by slightly soluble salts (e.g., calcium sulfate). In addition, calcium ions can be introduced as the salt of another preservative (e.g., sorbic acid, formic acid or acetic acid) or as the salt of a non-phosphate builder (e.g., citric acid). In some cases, a soluble salt of calcium is calcium chloride.

In some cases, a preservative can be included in the compositions provided herein from about 0.05% to about 6% by weight. For example, about 0.05% to about 4% by weight, about 0.05% to about 3% by weight, about 0.05% to about 2% by weight, about 0.05% to about 1% by weight, about 0.1% to about 6% by weight, about 0.25% to about 6% by weight, about 0.5% to about 6% by weight, about 1% to about 6% by weight, about 3% to about 5% by weight, about 0.25% to about 1% by weight, about 0.5% to about 1% by weight, about 1% to about 4% by weight, and about 2% to about 4% by weight of a preservative. In some cases, compositions provided herein can include about 0.25% to about 1% by weight or about 0.5% to about 1% by weight of a preservative. For example, compositions provided herein can include about 0.25% to about 1% by weight of a mixture of one or more of sorbic acid, soluble salt forms of sorbic acid, and calcium ions. In some cases, compositions provided herein can include about 0.25% to about 1% by weight of a mixture of sorbic acid and calcium ions. For example, compositions provided herein can include a mixture of 0.4% by weight of sorbic acid and 0.3% by weight of calcium chloride. In some cases, compositions provided herein can include about 1% to about 6% by weight or about 2% to about 4% by weight of a preservative. For example, compositions provided herein can include about 2% to about 4% by weight of a mixture of one or more of sorbic acid, soluble salt forms of sorbic acid, citric acid, soluble salts of citric acid, and calcium ions. In some cases, compositions provided herein can include about 2% to about 4% by weight of a mixture of sorbic acid, citric acid, and calcium ions. For example, compositions provided herein can include a mixture of 0.4% by weight of sorbic acid, 2.6% citric acid, and 0.3% by weight of calcium chloride.

In some cases, compositions provided herein can contain from about 0.05% to about 6% by weight of a mixture of one or more of sorbic acid, soluble salts of sorbic acid, citric acid, soluble salts of citric acid, and calcium ions. For example, about 0.05% to about 4% by weight, about 0.05% to about 3% by weight, about 0.05% to about 2% by weight, about 0.05% to about 1% by weight, about 0.1% to about 6% by weight, about 0.25% to about 6% by weight, about 0.5% to about 6% by weight, about 1% to about 6% by weight, about 3% to about 5% by weight, about 0.25% to about 1% by weight, about 0.5% to about 1% by weight, about 1% to about 4% by weight, and about 2% to about 4% by weight of a mixture of one or more of sorbic acid, soluble salts of sorbic acid, citric acid, soluble salts of citric acid, and calcium ions. In some cases, compositions provided herein can include about 1% to about 6% by weight or about 2% to about 4% by weight of a mixture of one or more of sorbic acid, soluble salts of sorbic acid, citric acid, soluble salts of citric acid, and calcium ions.

Flow Aid

Powdered detergent compositions provided herein can include a flow aid. A flow aid can help to reduce the stickiness of the powdered detergent granules. Non-limiting examples of flow aids include silica, silicates, and phosphates. In some embodiments, a flow aid can include a precipitated amorphous silica, fumed silica, silicon dioxide, calcium silicates (e.g., tricalcium silicate and dicalcium silicate), aluminosilicate, and/or tricalcium phosphate. In some embodiments, the flow aid can be a sodium aluminosilicate or precipitated amorphous silica.

In some cases, compositions provided herein can include from about 0.5% to about 5% by weight of a flow aid. For example, about 0.5% to about 4% by weight, about 0.5% to about 3% by weight, about 0.5% to about 2.5% by weight, about 0.5% to about 2% by weight, about 0.5% to about 1% by weight, about 1% to about 5% by weight, about 1.5% to about 5% by weight, about 2% to about 5% by weight, about 3% to about 5% by weight, about 1% to about 4% by weight, about 1.5% to about 2.5% by weight, and about 1% to about 3% by weight of a flow aid. In some cases, compositions provided herein can include about 1% to about 3% by weight or about 1.5% to about 2.5% by weight of a flow aid. For example, compositions provided herein can contain about 2% by weight of a flow aid. In some cases, compositions provided herein can contain about 2% by weight of silica such as precipitated amorphous silica.

In some cases, compositions provided herein can include from about 0.5% to about 5% by weight of silica. For example, about 0.5% to about 4% by weight, about 0.5% to about 3% by weight, about 0.5% to about 2.5% by weight, about 0.5% to about 2% by weight, about 0.5% to about 1% by weight, about 1% to about 5% by weight, about 1.5% to about 5% by weight, about 2% to about 5% by weight, about 3% to about 5% by weight, about 1% to about 4% by weight, about 1.5% to about 2.5% by weight, and about 1% to about 3% by weight of silica. In some cases, compositions provided herein can include about 1% to about 3% by weight or about 1.5% to about 2.5% by weight of silica. For example, compositions provided herein can contain about 2% by weight of silica. In some cases, compositions provided herein can contain about 2% by weight of precipitated amorphous silica.

Essential Oils

Compositions provided herein can also include one or more essential oils. Such oils can provide a boost in the cleaning power of the compositions and/or a fragrance to the composition. In some cases, an essential oil can be used in place of a fragrance in the compositions. Non-limiting examples of essential oils include: abies, bitter, seed, angelica, anise, balsam, basil, bay, benzoin, bergamot, birch, rose, cajuput, calamus, cananga, capsicum, caraway, cardamon, cassia, Japanese cinnamon, acacia, cedarwood, celery, camomile, hay podge, cinnamon, citronella, clove, coriander, costus, cumin, dill, elemi, estragon, eucalyptus, fennel, galbanum, garlic, geranium, ginger, ginger grass, grapefruit, guaiac wood, white cedar, hinoki, hop, hyacinth, Jasmine, jonquil, juniper berry, laurel, lavandin, lavender, lemon, lemongrass, lime, linaloe, richea cubeb, lovage, mandarin, Melaleuca alternifolia leaf oil, mint, minosa, mustard, myrrh, myrtle, narcissus, neroli, nutmeg, oak moss, ocotea, olibanum, onion, opopanax, orange, oris, parsley, patchouli, palmarosa, pennyroyal, pepper, perilla, petitgrain, pimento, pine, rose, rosemary, camphor, clary sage, sage, sandalwood, spearmint, spike, star anise, styrax, thyme, tonka, tuberose, terpin, vanilla, vetiver, violet, wintergreen, worm wood, and ylang ylang. In some cases, the essential oils are selected from Melaleuca alternifolia leaf oil and orange oil.

In some cases, compositions provided herein include from about 0.001% to about 5% by weight of one or more essential oils. For example, about 0.001% to about 4% by weight, about 0.001% to about 3% by weight, about 0.001% to about 2% by weight, about 0.001% to about 1% by weight, about 0.001% to about 0.5% by weight, about 0.001% to about 0.25% by weight, about 0.001% to about 0.1% by weight, about 0.001% to about 0.05% by weight, about 0.001% to about 0.01% by weight, about 0.001% to about 0.005% by weight, about 0.002% to about 5% by weight, about 0.003% to about 5% by weight, about 0.01% to about 5% by weight, about 0.1% to about 5% by weight, about 0.5% to about 5% by weight, about 1% to about 5% by weight, about 2% to about 5% by weight, about 3% to about 5% by weight, about 4% to about 5% by weight, about 0.002% to about 1% by weight, about 0.003% to about 1% by weight, about 0.01% to about 1% by weight, about 0.1% to about 1% by weight, about 0.5% to about 1% by weight, about 0.002% to about 0.005% by weight, about 2% to about 4% by weight, about 1% to about 3% by weight, about 0.5 to about 2.5% by weight, about 0.005% to about 0.01% by weight, about 0.01% to about 0.05% by weight, and about 0.1% to about 0.5% by weight of one or more essential oils. In some cases, compositions provided herein can contain about 0.002% to about 0.005% by weight of one or more essential oils. For example, compositions provided herein can contain about 0.003% by weight of one or more essential oils such as Melaleuca alternifolia leaf oil or orange oil. In some cases, compositions provided herein can contain about 0.003% by weight of Melaleuca alternifolia leaf oil.

In some cases, compositions provided herein include from about 0.001% to about 5% by weight of Melaleuca alternifolia leaf oil or orange oil. For example, about 0.001% to about 4% by weight, about 0.001% to about 3% by weight, about 0.001% to about 2% by weight, about 0.001% to about 1% by weight, about 0.001% to about 0.5% by weight, about 0.001% to about 0.25% by weight, about 0.001% to about 0.1% by weight, about 0.001% to about 0.05% by weight, about 0.001% to about 0.01% by weight, about 0.001% to about 0.005% by weight, about 0.002% to about 5% by weight, about 0.003% to about 5% by weight, about 0.01% to about 5% by weight, about 0.1% to about 5% by weight, about 0.5% to about 5% by weight, about 1% to about 5% by weight, about 2% to about 5% by weight, about 3% to about 5% by weight, about 4% to about 5% by weight, about 0.002% to about 1% by weight, about 0.003% to about 1% by weight, about 0.01% to about 1% by weight, about 0.1% to about 1% by weight, about 0.5% to about 1% by weight, about 0.002% to about 0.005% by weight, about 2% to about 4% by weight, about 1% to about 3% by weight, about 0.5 to about 2.5% by weight, about 0.005% to about 0.01% by weight, about 0.01% to about 0.05% by weight, and about 0.1% to about 0.5% by weight of Melaleuca alternifolia leaf oil or orange oil. In some cases, compositions provided herein can contain about 0.002 to about 0.005% by weight of Melaleuca alternifolia leaf oil or orange oil. For example, compositions provided herein can contain about 0.003% by weight of Melaleuca alternifolia leaf oil.

Fragrance

Compositions provided herein can include one or more fragrances. Fragrances and fragrant ingredients useful in the present compositions include a wide variety of natural and synthetic chemical ingredients, including, but not limited to, aldehydes, ketones, esters, and the like.

In some cases, compositions provided herein include from about 0.05 to about 2% by weight of fragrance. For example, about 0.05 to about 1% by weight, about 0.05 to about 0.5% by weight, about 0.05 to about 0.3% by weight, about 0.05 to about 0.1% by weight, about 0.1 to about 2% by weight, about 0.15 to about 2% by weight, about 0.3 to about 2% by weight, about 0.5 to about 2% by weight, about 1 to about 2% by weight, about 0.1 to about 0.3% by weight, about 0.05 to about 0.5% by weight, and 0.15% to about 0.25% by weight of fragrance. In some cases, compositions provided herein can contain about 0.1 to about 0.3% by weight or 0.15% to about 0.25% by weight of fragrance. For example, compositions provided herein can contain about 0.2% by weight of fragrance.

Phosphate Builders, Bleach, Bleaching Agents, Water, and Solvents

In some cases, the compositions provided herein lack one or more of phosphate builders, bleach, and bleaching agents. Phosphate builders can include, for example, orthophosphates such as trisodium phostate and disodium phosate, and complex (or condensed) phosphates such as tetrasodium pyrophosphate, sodium tripolyphosphate, sodium tetraphosphate, and sodium hexametaphosphate. In some cases, compositions provided herein can lack chlorine bleaches such as sodium hypochlorite and calcium hypochlorite. Bleaching agents can include peroxides, such as hydrogen peroxide, sodium percarbonate, sodium perborate, sodium dithionite, and sodium borohydride.

Compositions provided herein can also include less than about 1% by weight of water or other solvent. Solvents, as used herein, include organic and inorganic solvents such as alcohols (e.g., ethanol, isopropanol, methanol), dimethyl glyoxime, and polyols. In some cases, solvents include non-polar, polar, and polar aprotic solvents. In some cases, compositions provided herein include no or negligible amounts of water or other solvents.

As used herein, a "soluble salt" refers to a salt form of a compound that is soluble in water or other aqueous solution. Such salt forms are readily known to those having ordinary skill in the art. Examples of suitable cations of soluble salts include sodium, potassium, calcium, and magnesium salts. Examples of suitable anions of soluble salts include chloride, bromide, iodide, and nitrate.

Powdered Detergent Compositions

As described above, compositions provided herein can contain one or more of a low foaming nonionic surfactant, a non-phosphate detergent builder, a detergent enzyme, and a sheeting polymer. In some cases, the compositions can further include one or more of a preservative, a flow aid, an essential oil, and a fragrance. For example, compositions can include a low foaming nonionic surfactant, a non-phosphate detergent builder, a detergent enzyme, a sheeting polymer, and a preservative; a low foaming nonionic surfactant, a non-phosphate detergent builder, a detergent enzyme, a sheeting polymer, and a flow aid; a low foaming nonionic surfactant, a non-phosphate detergent builder, a detergent enzyme, a sheeting polymer, and an essential oil; a low foaming nonionic surfactant, a non-phosphate detergent builder, a detergent enzyme, a sheeting polymer, and a fragrance; a low foaming nonionic surfactant, a non-phosphate detergent builder, a detergent enzyme, a sheeting polymer, a preservative, and a flow aid; a low foaming nonionic surfactant, a non-phosphate detergent builder, a detergent enzyme, a sheeting polymer, a preservative, and an essential oil; a low foaming nonionic surfactant, a non-phosphate detergent builder, a detergent enzyme, a sheeting polymer, a preservative, and a fragrance; a low foaming nonionic surfactant, a non-phosphate detergent builder, a detergent enzyme, a sheeting polymer, a flow aid, and an essential oil; a low foaming nonionic surfactant, a non-phosphate detergent builder, a detergent enzyme, a sheeting polymer, a flow aid, and a fragrance; a low foaming nonionic surfactant, a non-phosphate detergent builder, a detergent enzyme, a sheeting polymer, an essential oil, and a fragrance; a low foaming nonionic surfactant, a non-phosphate detergent builder, a detergent enzyme, a sheeting polymer, a preservative, and a flow aid; a low foaming nonionic surfactant, a non-phosphate detergent builder, a detergent enzyme, a sheeting polymer, a preservative, a flow aid, and an essential oil; a low foaming nonionic surfactant, a non-phosphate detergent builder, a detergent enzyme, a sheeting polymer, a preservative, a flow aid, an essential oil, and a fragrance; a low foaming nonionic surfactant, a non-phosphate detergent builder, a detergent enzyme, a sheeting polymer, a flow aid, an essential oil, and a fragrance; and a low foaming nonionic surfactant, a non-phosphate detergent builder, a detergent enzyme, a sheeting polymer, a preservative, an essential oil, and a fragrance.

For example, provided herein is a powder detergent composition comprising or consisting of:

(a) about 0.5 to about 15% by weight of a surfactant, wherein said surfactant is a low foaming nonionic surfactant;
(b) about 30 to about 90% by weight of a non-phosphate detergent builder;
(c) about 0.02 to about 5% by weight of a detergent enzyme; and
(d) about 0.05 to about 3% by weight of a sheeting polymer.

In some cases, the above composition further comprises from about 0.001 to about 5% by weight (e.g., 0.001 to about 1% by weight) of one or more essential oils. For example, Melaleuca alternifolia leaf oil or orange oil. In some cases, the above composition can also include from about 0.5 to about 5% by weight of a flow aid. In some cases, the above composition further includes from about 0.05 to about 2% by weight of fragrance.

For example, a composition provided herein can include or consist of:

(a) about 0.5 to about 15% by weight of a surfactant, wherein said surfactant is a low foaming nonionic surfactant;
(b) about 30 to about 90% by weight of a non-phosphate detergent builder, wherein said non-phosphate detergent builder is selected from the group consisting of citric acid or a salt form thereof;
(c) about 0.02 to about 5% by weight of a detergent enzyme;
(d) about 0.05 to about 3% by weight of a sheeting polymer;
(e) about 0 to about 5% by weight of a preservative;
(f) about 0.5 to about 5% by weight of a flow aid;
(g) from 0 to about 5% by weight of one or more essential oils; and
(h) from 0 to about 2% by weight of fragrance.

In some embodiments, a composition provided herein includes or consists of:

(a) about 1 to about 10% by weight of a surfactant, wherein said surfactant is a low foaming nonionic surfactant;
(b) about 80 to about 90% by weight of a non-phosphate detergent builder, wherein said non-phosphate detergent builder is selected from the group consisting of citric acid or a salt form thereof;
(c) about 0.5 to about 2% by weight of a detergent enzyme; and
(d) about 0.1 to about 1% by weight of a sheeting polymer;
(e) wherein the composition comprises less than about 1% by weight of water or other solvent.

In some cases, the above composition further comprises from about 0.001 to about 5% by weight (e.g., about 0.001 to about 1% by weight) of one or more essential oils. For example, Melaleuca alternifolia leaf oil or orange oil. In some cases, the above composition can also include from about 0.5 to about 5% by weight of a flow aid. In some cases, the above composition further includes from about 0.05 to about 2% by weight of fragrance.

For example, a composition can include or consist of:

(a) about 1 to about 10% by weight of a surfactant, wherein said surfactant is a low foaming nonionic surfactant;
(b) about 80 to about 90% by weight of a non-phosphate detergent builder, wherein said non-phosphate detergent builder is selected from the group consisting of citric acid or a salt form thereof;
(c) about 0.5 to about 2% by weight of a detergent enzyme;
(d) about 0.1 to about 1% by weight of a sheeting polymer;
(e) about 0 to about 5% by weight of a preservative;
(f) about 0.5 to about 5% by weight of a flow aid;
(g) from 0 to about 1% by weight of one or more essential oils; and
(h) from 0 to about 2% by weight of fragrance.

In some cases, a composition provided herein includes or consists of:

(a) about 1 to about 10% by weight of a polyoxypropylene polyoxyethylene condensate;
(b) about 80 to about 90% by weight of sodium citrate dihydrate;
(c) about 0.5 to about 2% by weight of a mixture of amylase and protease enzymes; and
(d) about 0.1 to about 1% by weight of diallyldimethylammonium chloride.

In some cases, the above composition further comprises from about 0.001 to about 5% by weight (e.g., about 0.001 to about 1% by weight) of one or more essential oils. For example, Melaleuca alternifolia leaf oil or orange oil. In some cases, the above composition can also include from about 0.5 to about 5% by weight of a flow aid. In some cases, the above composition further includes from about 0.05 to about 2% by weight of fragrance.

For example, a composition provided herein can include or consist of:

(a) about 1 to about 10% by weight of a polyoxypropylene polyoxyethylene condensate;
(b) about 80 to about 90% by weight of sodium citrate dihydrate;
(c) about 0.5 to about 2% by weight of a mixture of amylase and protease enzymes;
(d) about 0.1 to about 1% by weight of diallyldimethylammonium chloride;
(e) about 0.05 to about 5% by weight of a mixture of sorbic acid, citric acid, and calcium chloride;
(f) about 0.5 to about 5% by weight of silica;
(g) from 0 to about 1% by weight of Melaleuca alternifolia leaf oil; and
(h) from 0 to about 2% by weight of fragrance.

In some cases, a composition provided herein includes or consists of:

(a) about 6% by weight of a polyoxypropylene polyoxyethylene condensate;
(b) about 87% by weight of sodium citrate dihydrate;
(c) about 1% by weight of a mixture of amylase and protease enzymes; and
(d) about 0.5% by weight of diallyldimethylammonium chloride.

In some cases, the above composition further comprises from about 0.001 to about 1% by weight of one or more essential oils. For example, Melaleuca alternifolia leaf oil or orange oil. In some cases, the above composition can also include from about 0.5 to about 5% by weight of a flow aid. In some cases, the above composition further includes from about 0.05 to about 2% by weight of fragrance.

For example, a composition provided herein can include or consist of:

(a) about 6% by weight of a polyoxypropylene polyoxyethylene condensate;
(b) about 87% by weight of sodium citrate dihydrate;
(c) about 1% by weight of a mixture of amylase and protease enzymes;
(d) about 0.5% by weight of diallyldimethylammonium chloride;
(e) about 3.4% by weight of a mixture of sorbic acid, citric acid, and calcium chloride;
(f) about 2% by weight of silica;
(g) about 0.003% by weight of Melaleuca alternifolia leaf oil; and
(h) about 0.2% by weight of fragrance.

In any of the above compositions, the composition can include less than about 1% by weight of water or other solvent. In some cases, any of the above compositions can be free of phosphate builders, bleach, and/or bleaching agents.

Further provided herein is an automatic dishwashing detergent packet. This packet can include a water soluble container comprising a water-soluble film; and a powder detergent composition provided herein within the container. In some embodiments, the automatic dishwashing detergent packet can be a monophasic automatic dishwashing detergent packet. As used herein, the term "monophasic" refers to the presence of a single composition (e.g., a single powdered composition) within the water-soluble container. In some embodiments, the compositions provided herein can be included in multi-pocketed (e.g., two pockets, three pockets, or four pockets) automatic dishwashing detergent packets, where different powdered or liquid compositions can be contained in separate pockets created by layers or compartments made with the water-soluble films.

Packets as provided herein contain powder compositions which are compatible with the water-soluble containers in which they are stored. For example, the powdered compositions do not substantially degrade the containers or breach their containment.

The packets are suitable for cleaning a variety of materials, and enable relatively safe and efficient handling of concentrates by both skilled and unskilled laborers.

The container provided herein comprises a water-soluble material. As used herein, a water-soluble material is defined as a material which substantially dissolves in response to being contacted with water. In some cases, the water-soluble material can be in the form of a film. Suitable materials for the film include polyvinyl alcohol and partially hydrolyzed polyvinyl acetate and alginates. In some cases, the films include polyvinyl alcohol. For example, the container can consists essentially of or consist of a water-soluble film and the water-soluble film consists essentially of or consists of polyvinyl alcohol. Other water-soluble materials can include materials having water-solubilities ranging from partial solubility in hot water to complete solubility in cold water. For example, in the case of a packet containing automatic dishwashing powder, it is sufficient that water at wash temperatures will cause enough disintegration of the film to allow release of the contents from the package into the wash water.

The thickness of the film itself should be sufficient to give it the required mechanical strength. Typically, the thickness of the film will lie within the range of from 0.5 to 10 mil (12.7 μm to 254 μm). For example, from 1 to 5 mil, from 1 to 3 mil, from 1.5 to 3 mil, and from 1 to 4 mil. In some embodiments, the film thickness is 3 mil (76 μm). The films can also have a high bursting strength. The film is also capable of undergoing high heat-sealing, since heat-sealing represents a convenient and inexpensive method of making packets as described herein.

In some embodiments, the film can include Monosol® having a thickness of about 1.5 to about 3 mil. In some embodiments, the top and the bottom film have different thicknesses. For example, the top film can be 2 mil and the bottom film can be 3 mil.

The film or container can be uncoated. In most cases, the compositions provided herein are compatible with the water-soluble container, and thus, protective coatings may not be necessary to provide adequate stability to the packet.

In some cases, the packets provided herein are conveniently in the form of a bag or sachet. The packet may be formed from one or more sheets of a packaging film or from a tubular section of such film. For example, the packet can be formed from a single folded sheet or from two sheets, sealed together at the edge regions either by means of an adhesive or by heat-sealing. In some cases, a packet provided herein can be a rectangular one formed from a single folded sheet sealed on three sides, with the fourth side sealed after filling the packet with a powder composition provided herein. Accordingly, the packet will have a single-layer of a water-soluble film wherein the water-soluble film has an internal surface directly contacting a powder detergent composition and an external surface which is an outermost portion of the packet.

The compositions provided herein can be used in an automatic dishwashing machine. For example, provided herein are methods of cleaning non-textile surfaces such as tableware (e.g., plates, cups, flatware, etc.) using an effective amount of a composition provided herein. In some cases, an effective amount of a composition is one or more packets as described herein. For example, one packet can be used to effectively clean tableware in an automatic dishwashing machine. In some cases, one packet is effective to clean tableware without the addition of a separate rinse aid.

EXAMPLES

The invention is further described in the following examples, which do not limit the scope of the invention described in the claims.

Example 1

| Component | % by weight |
|---|---|
| Sodium Citrate dihydrate | 87 |
| Sorbic acid | 0.4 |
| Citric Acid | 2.6 |
| Calcium chloride | 0.3 |
| Meroxapol 252; Pluronic 25R2 (low foaming non-ionic surfactant—see below) | 6 |
| Diallyldimethylammonium chloride—(sheeting polymer) | 0.500 |
| Amylase Enyzme | 0.500 |
| Protease Enzyme | 0.500 |
| Precipitated amorphous silica (flow aid) | 2.000 |
| Melaleuca alternifolia Leaf oil | 0.003 |
| Fragrance | 0.200 |

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A powder detergent composition consisting of:

(a) about 0.5 to about 15% by weight of a surfactant, wherein said surfactant is a low foaming nonionic surfactant;

(b) about 70 to about 90% by weight of a non-phosphate detergent builder, wherein said non-phosphate detergent builder is selected from the group consisting of citric acid, a soluble salt form of citric acid, and mixtures thereof;

(c) about 0.02 to about 5% by weight of a detergent enzyme;

(d) about 0.05 to about 3% by weight of diallyldimethylammonium chloride (DMDAAC);

(e) about 0.05 to about 5% by weight of a preservative;

(f) about 0.001 to about 5% by weight of one or more essential oils;

(g) 0 to about 2% by weight of fragrance;

(h) optionally about 0.5 to about 5% by weight of a flow aid; and (i) less than about 1% by weight of water or other solvent.

2. The powder of claim 1, wherein said low foaming nonionic surfactant is selected from the group consisting of:

(a) first condensation products, wherein said first condensation products are condensates from a first mixture containing about one mole of a straight or branched chain fatty alcohol or fatty acid and from about four to about forty moles of ethylene oxide, wherein said alcohol or acid is saturated or unsaturated, and wherein the chain of said alcohol or acid contains from about ten to about twenty carbon atoms;

(b) second condensation products, wherein said second condensation products are condensates from a second mixture containing about one mole of alkyl phenol and from about four to about fifty moles of ethylene oxide, wherein the alkyl chain of said alkyl phenol contains from about eight to about eighteen carbon atoms;

(c) polyoxypropylene, polyoxyethylene condensates having the formula $R_1O(CH_2CH_2O)_x(CH(CH_3)CH_2O)_yR_2$, wherein $R_1$ is H or an alkyl group having from one to four carbon atoms, wherein $R_2$ is H or an alkyl group having from one to four carbon atoms, wherein x is an integer greater than or equal to one, wherein y is an integer greater than or equal to one, wherein the total $C_2H_4O$ content is from about 20 percent to about 90 percent of the total weight of said polyoxypropylene, polyoxyethylene condensates, and wherein the molecular weight of said polyoxypropylene, polyoxyethylene condensates is from about 2000 Daltons to about 10,000 Daltons; and (d) capped condensates, wherein said capped condensates comprise said polyoxypropylene, polyoxyethylene condensates capped with at least one capping molecule, said capping molecule being selected from the group consisting of propylene oxide, butylene oxide, short chain alcohols, and short chain fatty acids.

3. The powder of claim 1, wherein said surfactant is a polyoxypropylene polyoxyethylene condensate.

4. The powder of claim 1, wherein said non-phosphate detergent builder is a soluble salt of citric acid.

5. The powder of claim 4, wherein said non-phosphate detergent builder is an alkali metal salt of citric acid, an ammonium salt of citric acid, or a mixture thereof.

6. The power of claim 5, wherein said non-phosphate detergent builder is a sodium salt of citric acid.

7. The powder of claim 6, wherein said non-phosphate detergent builder is sodium citrate dihydrate.

8. The powder of claim 1, wherein said detergent enzyme is selected from lipases, mannanases, cellulases, zylenases, proteases, amylases, and mixtures of two or more thereof.

9. The powder of claim 8, wherein said detergent enzyme is selected from a protease, an amylase, or mixtures thereof.

10. The powder of claim 1, wherein said one or more essential oils are selected from the group consisting of: abies, bitter, seed, angelica, anise, balsam, basil, bay, benzoin, bergamot, birch, rose, cajuput, calamus, cananga, capsicum, caraway, cardamon, cassia, Japanese cinnamon, acacia, cedarwood, celery, camomile, hay podge, cinnamon, citronella, clove, coriander, costus, cumin, dill, elemi, estragon, eucalyptus, fennel, galbanum, garlic, geranium, ginger, ginger grass, grapefruit, guaiac wood, white cedar, hinoki, hop, hyacinth, Jasmine, jonquil, juniper berry, laurel, lavandin, lavender, lemon, lemongrass, lime, linaloe, richea cubeb, lovage, mandarin, Melaleuca alternifolia leaf oil, mint, minosa, mustard, myrrh, myrtle, narcissus, neroli, nutmeg, oak moss, ocotea, olibanum, onion, opopanax, orange, oris, parsley, patchouli, palmarosa, pennyroyal, pepper, perilla, petitgrain, pimento, pine, rose, rosemary, camphor, clary sage, sage, sandalwood, spearmint, spike, star anise, styrax, thyme, tonka, tuberose, terpin, vanilla, vetiver, violet, wintergreen, worm wood, and ylang ylang.

11. The powder of claim 10, wherein said essential oils are selected from the group consisting of: Melaleuca alternifolia leaf oil and orange oil.

12. The powder of claim 1, wherein said preservative is selected from the group consisting of propylene glycol, sorbitol, fructose, sucrose, glucose, short chain carboxylic acids, salt forms of short chain carboxylic acids, polyhydroxyl compounds, boric acid, soluble salt forms of boric acid, boronic acid, soluble salt forms of boronic acid, sorbic acid, soluble salt forms of sorbic acid, soluble salt forms of calcium, and mixtures thereof.

13. The powder of claim 12, wherein said preservative is selected from sorbic acid, soluble salt forms of sorbic acid, soluble salt forms of calcium, and mixtures thereof.

14. The powder of claim 1, wherein [said composition further comprises from about 0.5 to about 5% by weight of a] the flow aid is present in the composition.

15. The powder of claim 14, wherein said flow aid is selected from the group consisting of: silica and aluminosilicate.

16. The powder of claim 1, wherein [said composition further comprises from about 0.05 to about 2% by weight of] the fragrance is present in the composition in an amount from about 0.05 to about 2% by weight.

17. The powder of claim 1, wherein said composition consists of:

(a) about 0.5 to about 15% by weight of a surfactant, wherein said surfactant is a low foaming nonionic surfactant;
(b) about 70 to about 90% by weight of a non-phosphate detergent builder, wherein said non-phosphate detergent builder is selected from the group consisting of citric acid, a soluble salt form of citric acid, and mixtures thereof;
(c) about 0.02 to about 5% by weight of a detergent enzyme;
(d) about 0.05 to about 3% by weight of diallyldimethylammonium chloride (DMDAAC);
(e) about 0.05 to about 5% by weight of a preservative;
(f) about 0.5 to about 5% by weight of a flow aid;
(g) from 0.001 to about 5% by weight of one or more essential oils;
(h) from 0 to about 2% by weight of fragrance; and
(i) less than about 1% by weight of water or other solvent.

18. The powder of claim 1, wherein said composition consists of:

(a) about 1 to about 10% by weight of a surfactant, wherein said surfactant is a low foaming nonionic surfactant;
(b) about 80 to about 90% by weight of a non-phosphate detergent builder, wherein said non-phosphate detergent builder is selected from the group consisting of citric acid, a soluble salt form of citric acid, and mixtures thereof;
(c) about 0.5 to about 2% by weight of a detergent enzyme;
(d) about 0.1 to about 1% by weight of diallyldimethylammonium chloride (DMDAAC);
(e) about 0.05 to about 5% by weight of a preservative;
(f) about 0.001 to about 5% by weight of one or more essential oils;
(g) less than about 1% by weight of water or other solvent.

19. The powder of claim 18, wherein said composition consists of:

(a) about 1 to about 10% by weight of a surfactant, wherein said surfactant is a low foaming nonionic surfactant;
(b) about 80 to about 90% by weight of a non-phosphate detergent builder, wherein said non-phosphate detergent builder is selected from the group consisting of citric acid, a soluble salt form of citric acid, and mixtures thereof;
(c) about 0.5 to about 2% by weight of a detergent enzyme;
(d) about 0.1 to about 1% by weight of diallyldimethylammonium chloride (DMDAAC);
(e) about 0.05 to about 5% by weight of a preservative;
(f) about 0.5 to about 5% by weight of a flow aid;
(g) from 0.001 to about 1% by weight of one or more essential oils;
(h) from 0 to about 2% by weight of fragrance; and
(i) less than about 1% by weight of water or other solvent.

20. An automatic dishwashing detergent packet comprising:

(a) a water soluble container comprising a water-soluble film; and
(b) a powder detergent composition of claim 1 within said container.

21. The packet of claim 20, wherein said container comprises a single-layer of said water-soluble film wherein said water-soluble film has an internal surface directly contacting said powder detergent composition and an external surface which is an outermost portion of said packet.

22. The packet of claim 20, wherein said water-soluble film comprises polyvinyl alcohol.

23. The packet of claim 20, wherein said container consists essentially of said water-soluble film and said water-soluble film consists essentially of polyvinyl alcohol.

24. The packet of claim 20, wherein said automatic dishwashing detergent packet is a monophasic automatic dishwashing detergent packet.

25. A powder detergent composition consisting of:

(a) about 0.5 to about 15% by weight of a surfactant, wherein said surfactant is a low foaming nonionic surfactant;

(b) about 70 to about 90% by weight of a non-phosphate detergent builder, wherein said non-phosphate detergent builder is selected from the group consisting of citric acid, a soluble salt form of citric acid, and mixtures thereof;

(c) about 0.02 to about 5% by weight of a detergent enzyme;

(d) about 0.05 to about 3% by weight of an ionic sheeting polymer;

(e) about 0.05 to about 5% by weight of a mixture of a soluble salt form of calcium and at least one of sorbic acid, a soluble salt form of sorbic acid, or mixtures thereof;

(f) about 0.001 to about 5% by weight of one or more essential oils;

(g) 0 to about 2% by weight of fragrance;

(h) optionally about 0.5 to about 5% by weight of a flow aid; and (i) less than about 1% by weight of water or other solvent.

26. The powder of claim 25, wherein said surfactant is a polyoxypropylene polyoxyethylene condensate.

27. The powder of claim 25, wherein [said composition further comprises from about 0.5 to about 5% by weight of a] the flow aid is present in the composition and wherein the flow aid is selected from the group consisting of silica and aluminosilicate.

28. The powder of claim 25, wherein said composition consist of:

(a) about 1 to about 10% by weight of a surfactant, wherein said surfactant is a low foaming nonionic surfactant;

(b) about 80 to about 90% by weight of a non-phosphate detergent builder, wherein said non-phosphate detergent builder is selected from the group consisting of citric acid, a soluble salt form of citric acid, and mixtures thereof;

(c) about 0.5 to about 2% by weight of a detergent enzyme;

(d) about 0.1 to about 1% by weight of an ionic sheeting polymer;

(e) about 0.05 to about 5% by weight of a mixture of a soluble salt form of calcium and at least one of sorbic acid, a soluble salt form of sorbic acid, or mixtures thereof;

(f) about 0.5 to about 5% by weight of a flow aid;

(g) from 0.001 to about 1% by weight of one or more essential oils;

(h) from 0 to about 2% by weight of fragrance; and (i) less than about 1% by weight of water or other solvent.

29. An automatic dishwashing detergent packet comprising:

(a) a water soluble container comprising a water-soluble film; and (b) a powder detergent composition of claim 25 within said container.

* * * * *